US006817201B2

(12) United States Patent
Yingst

(10) Patent No.: US 6,817,201 B2
(45) Date of Patent: Nov. 16, 2004

(54) HOT/COLD PRODUCT MERCHANDISER

(75) Inventor: Thomas E. Yingst, St. Louis, MO (US)

(73) Assignee: Duke Manufacturing Company, St. Louis, MO (US)

( * ) Notice: Subject to any disclaimer, the term of this patent is extended or adjusted under 35 U.S.C. 154(b) by 0 days.

(21) Appl. No.: 10/413,732

(22) Filed: Apr. 15, 2003

(65) Prior Publication Data

US 2003/0233841 A1 Dec. 25, 2003

Related U.S. Application Data

(60) Provisional application No. 60/390,931, filed on Jun. 24, 2002.

(51) Int. Cl.[7] ..... A47F 3/04

(52) U.S. Cl. ..... 62/246; 62/258; 165/48.1

(58) Field of Search ..... 62/246, 249, 252, 62/258; 165/48.1, 58, 61, 62, 63, 73, 75

(56) References Cited

U.S. PATENT DOCUMENTS

| | | | | |
|---|---|---|---|---|
| 2,545,602 A | | 3/1951 | Burger | |
| 2,863,708 A | | 12/1958 | Cahn | |
| 3,170,541 A | | 2/1965 | Werner | |
| 3,759,059 A | | 9/1973 | Kenyon | |
| 3,841,440 A | * | 10/1974 | Weddendorf | 186/44 |
| 4,027,727 A | | 6/1977 | Pullens | |
| 4,250,955 A | * | 2/1981 | Plattner et al. | 165/244 |
| 4,343,985 A | * | 8/1982 | Wilson et al. | 219/214 |
| 4,593,752 A | | 6/1986 | Tipton | |
| 4,704,870 A | | 11/1987 | Beitner | |
| 4,836,622 A | * | 6/1989 | Ferguson | 312/114 |
| 4,856,579 A | | 8/1989 | Wolfe | |
| 4,884,626 A | | 12/1989 | Filipowski | |
| 4,949,554 A | * | 8/1990 | Branz et al. | 62/248 |
| 5,203,180 A | * | 4/1993 | Weisbrich | 62/247 |
| 5,203,255 A | | 4/1993 | Wells et al. | |
| D352,192 S | | 11/1994 | Gelinas | |
| D352,620 S | | 11/1994 | Geisen et al. | |
| 5,491,980 A | | 2/1996 | Yingst et al. | |
| 5,496,103 A | | 3/1996 | Kozak | |
| 5,590,541 A | * | 1/1997 | Rainwater | 62/255 |
| 5,630,468 A | | 5/1997 | McKee | |
| 5,743,098 A | | 4/1998 | Behr | |
| 5,964,512 A | | 10/1999 | Borgen | |
| D442,393 S | | 5/2001 | Shei et al. | |
| 6,257,010 B1 | | 7/2001 | Shei et al. | |
| 6,367,274 B1 | | 4/2002 | Mellado | |
| 6,412,296 B1 | * | 7/2002 | Rossi | 62/255 |
| 6,705,107 B2 | * | 3/2004 | Schlosser et al. | 62/344 |

FOREIGN PATENT DOCUMENTS

DE 3337467 A * 4/1985

* cited by examiner

*Primary Examiner*—William C. Doerrler
*Assistant Examiner*—Mohammad M. Ali
(74) *Attorney, Agent, or Firm*—Senniger Powers

(57) ABSTRACT

A counter top merchandiser for holding and displaying hot and cold products. The merchandiser includes a warm compartment within the merchandiser for holding and displaying warm products. A cold compartment below the warm compartment is defined in part by a bottom wall positioned above the counter top when the merchandiser is placed on the counter top. The cold compartment has a display section and a storage section. A partition separates the warm and cold compartments. A heating unit heats products within the warm compartment and a refrigeration unit cools products within the cold compartment. At least one transparent wall allows viewing of products within the merchandiser. Openings provide access to the warm and cold compartments from the rear of the merchandiser.

30 Claims, 18 Drawing Sheets

HOT/COLD PRODUCT MERCHANDISER

CROSS REFERENCE TO RELATED APPLICATIONS

This application claims priority from U.S. Provisional Application Ser. No. 60/390,931, filed Jun. 24, 2002, the entire text of which is hereby incorporated herein by reference.

BACKGROUND OF THE INVENTION

The present invention relates generally to a product display unit, and more particularly to a counter top merchandiser for holding and displaying both hot and cold products.

One such application for this invention is the storage and display of hot and cold food products. However, it is contemplated that other types of hot and cold products may be stored and displayed in the merchandiser. This invention is particularly related to the technology disclosed in U.S. Pat. No. 6,257,010 entitled "Merchandiser for Warm and Cold Food", issued Jul. 10, 2001, owned by Duke Manufacturing Co. of St. Louis, Mo., and incorporated herein by reference for all purposes. The merchandiser disclosed in this patent is described as being adapted to rest on a counter with its upper compartment elevated somewhat above the counter top and its lower compartment recessed into the counter, i.e., positioned in an opening cut in the counter top to receive the cold pan of the device. Cutting such an opening increases the cost of installation. Further, in the event the merchandiser is later removed, the counter top must be replaced or repaired to cover the opening. Therefore, there is a need for a counter top merchandiser which can be installed without requiring an opening in the counter top.

SUMMARY OF THE INVENTION

Among the several objects of this invention may be noted the provision of a hot/cold product merchandiser which can be installed on a counter top without cutting a hole in the counter top; the provision of such a merchandiser which is easy to install on a counter top and to remove from the counter top; the provision of such a merchandiser which displays products in the merchandiser in a way which is pleasing to customers; the provision of such a merchandiser which is attractive in appearance and which is easy to use; the provision of such a merchandiser which has a product display section and a product storage section from which products can be removed as they are sold without disturbing the products in the display section; the provision of such a merchandiser which, in a preferred embodiment, has a front which is permanently closed to deny customers access to the merchandiser but which is transparent to permit viewing of the product in the merchandiser; the provision of such a merchandiser which, in a preferred embodiment, allows independent access to the cold compartment from both sides of the merchandiser; and the provision of such a merchandiser which has a warm compartment for storing warm products and a cold compartment for storing cold products.

In general, a counter top merchandiser of the present invention comprises a warm compartment within the merchandiser for holding and displaying warm products. A cold compartment is below the warm compartment and defined in part by a bottom wall positioned above the counter top when the merchandiser is placed on the counter top. The cold compartment has a display section and a storage section. A partition separates the warm and cold compartments. A heating unit heats products within the warm compartment and a refrigeration unit cools products within the cold compartment. At least one transparent wall allows viewing of products within the merchandiser. Openings provide access to the warm and cold compartments from the rear of the merchandiser.

The present invention is also directed to a method of using such a merchandiser. The method includes the steps of placing cold products to be viewed in the display section and placing cold products to be removed for customer use in the storage section. Warm products to be viewed and stored are placed in the warm compartment. The refrigeration unit is operated to cool products in the cold compartment and the heating unit is operated to heat products in the warm compartment.

Other objects and features of the present invention will be in part apparent and in part pointed out hereinafter.

BRIEF DESCRIPTION OF THE DRAWINGS

Corresponding parts are designated by corresponding reference numbers throughout the drawings.

DESCRIPTION OF THE PREFERRED EMBODIMENT

Figure 1:
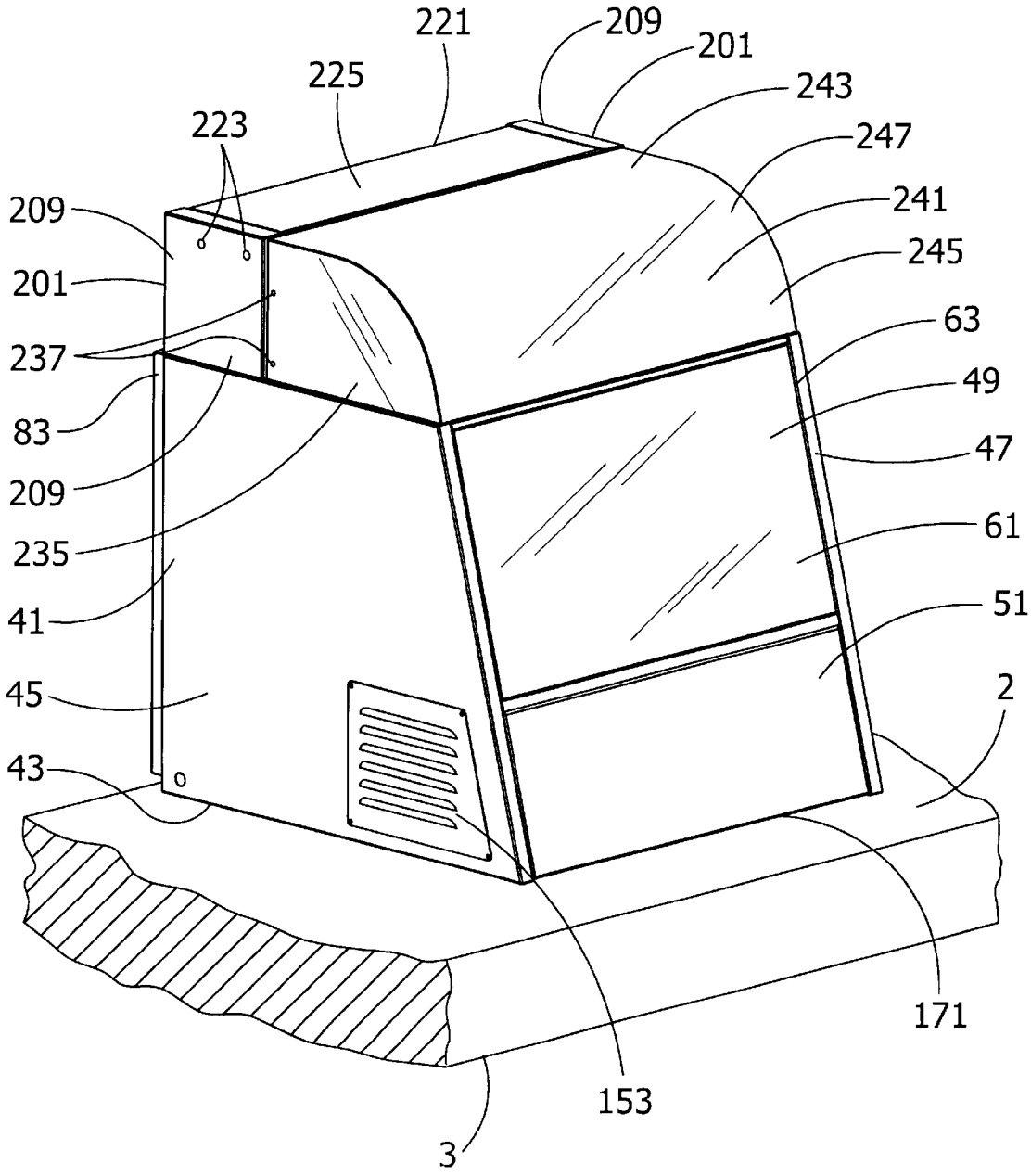
FIG. 1 is a left-side perspective view of a counter top hot/cold merchandiser of a first embodiment of the present invention.
Figure 2:
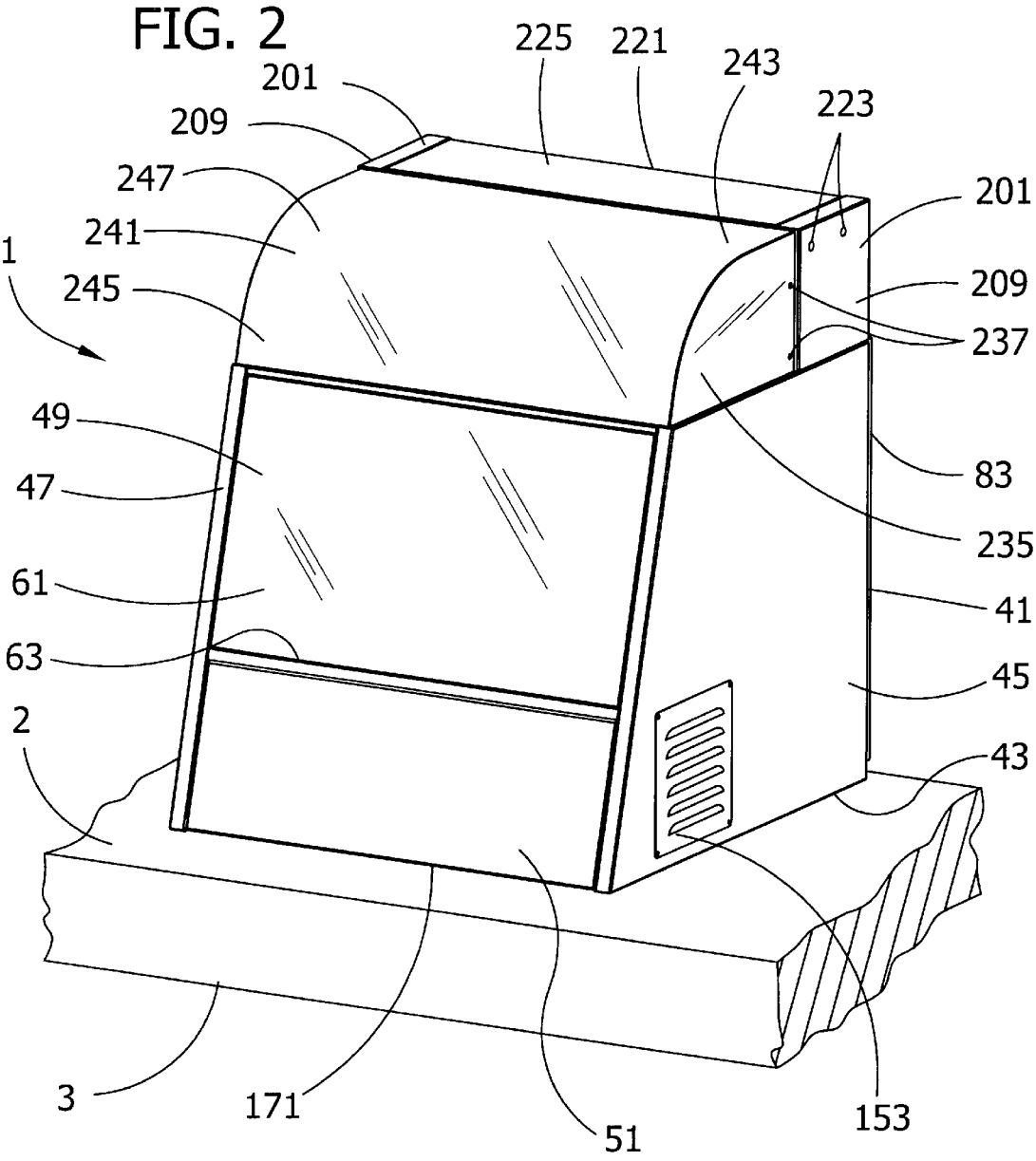
FIG. 2 is a right-side perspective view of the merchandiser.
Figure 3:
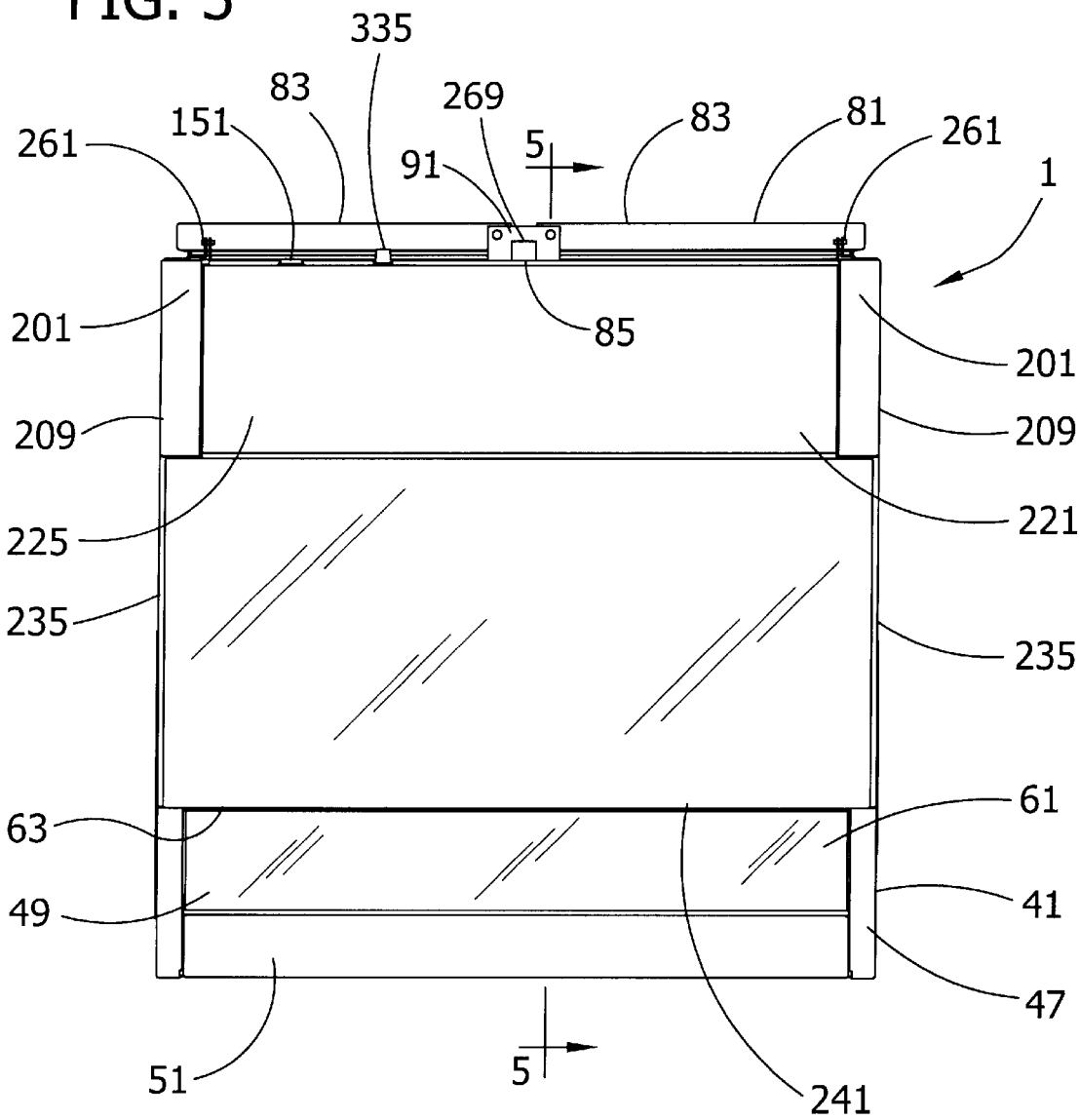
FIG. 3 is a top view of the merchandiser.
Figure 4:
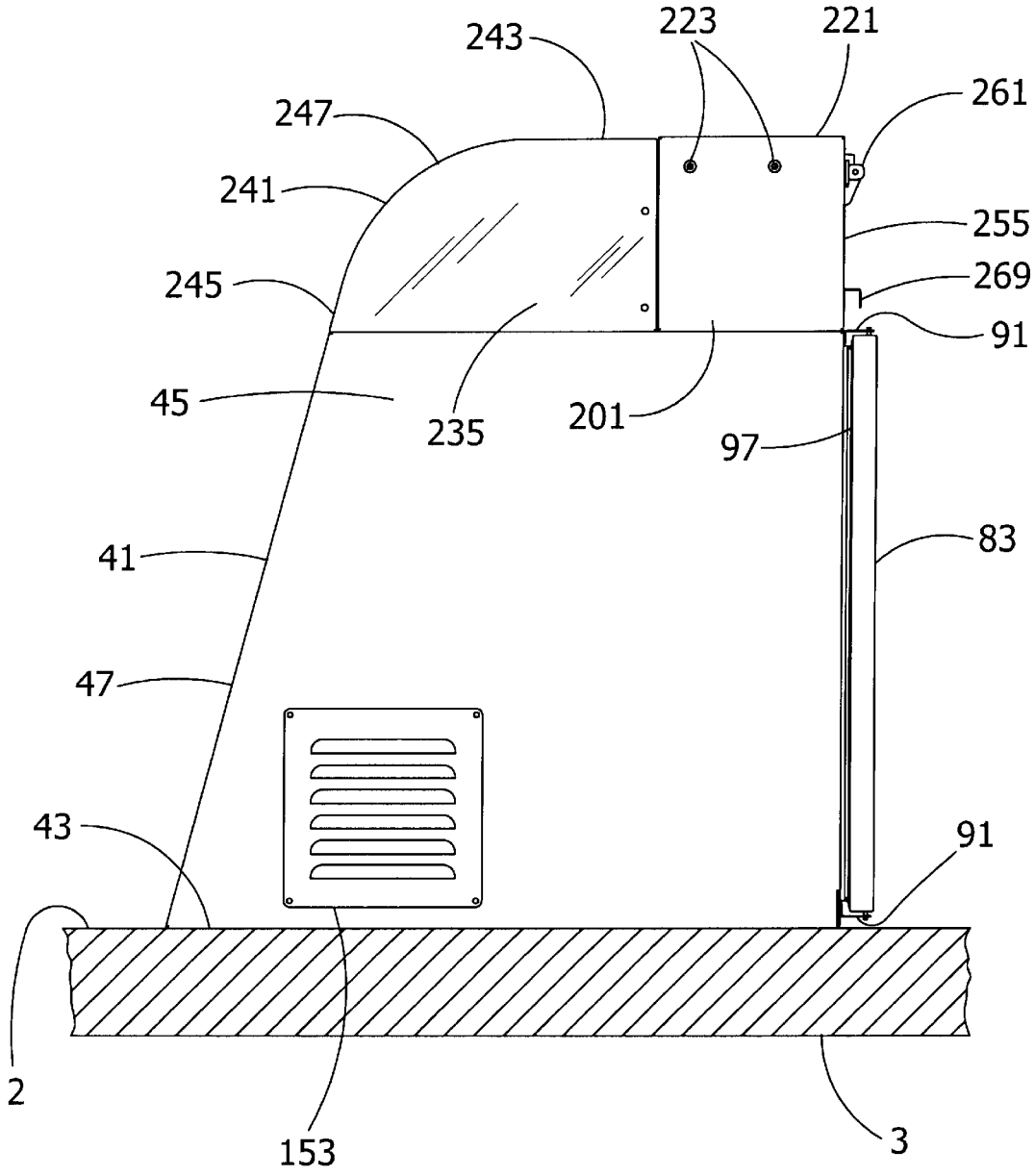
FIG. 4 is a left side elevation view of the merchandiser.

Referring now to the drawings, and more particularly to FIGS. 1–5, a hot/cold counter top merchandiser of the present invention is designated in its entirety by the reference numeral 1. As shown in FIGS. 1–3, the merchandiser 1 is adapted to be mounted on a counter top, designated 3, without having to cut an opening in the counter top, or otherwise damaging the counter top, so that if and when the merchandiser is removed, the counter top can be used without being replaced or repaired.

Figure 5:
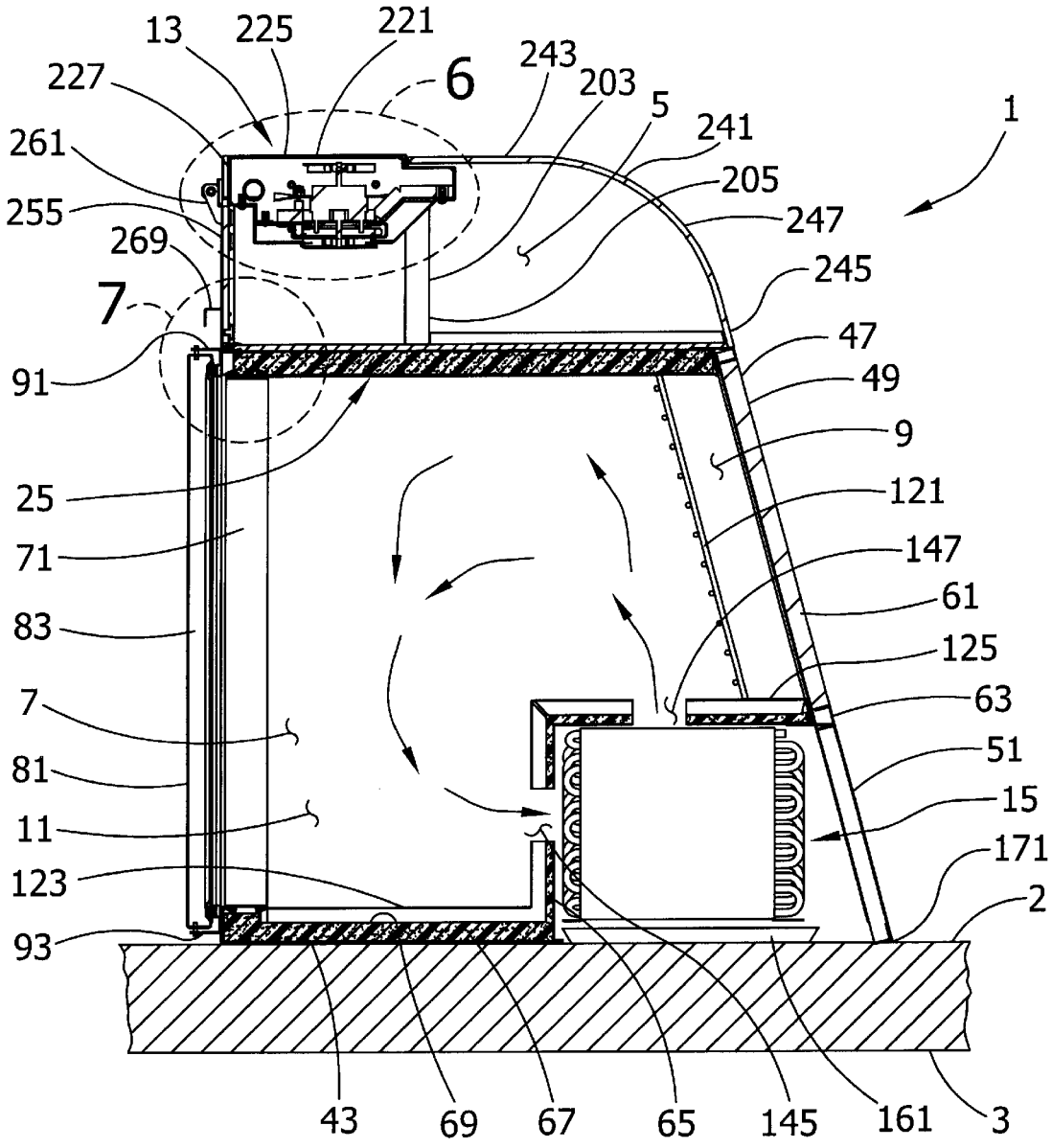
FIG. 5 is a sectional view of the merchandiser taken along plane 5—5 of FIG. 3.

As shown best in FIG. 5, the merchandiser 1 has an upper warm compartment 5 for holding and displaying warm products and a lower cold compartment 7 for holding and displaying cold products. In accordance with one aspect of the present invention, the cold compartment 7 has a front display section 9 for displaying products to prospective customers, and a rear storage section 11 for storing products to be sold or otherwise distributed. The products in the warm compartment 5 are heated by a heating unit, generally designated 13. The products in the cold compartment are cooled by a refrigeration unit, generally designated 15. A partition 25 separates the warm compartment 5 from the cold compartment 7. In one embodiment (FIG. 7), the partition 25 comprises a layer of fiberglass insulation 27 and a layer of foam insulation 29 disposed between a top stainless steel panel 31 and a lower sheet metal panel 33.

In one embodiment, the cold compartment 7 is defined by a cabinet of sheet metal 41 (e.g., galvanized steel) and by the partition 25 which is affixed to the cabinet. The cabinet 41 has a bottom wall 43, opposite side walls 45, and a front wall 47 which includes upper and lower panels, 49 and 51 respectively, mounted in openings in the front wall. The upper panel 49 is preferably transparent, forming a window 61 to allow viewing of products in the display section 9 of the cold compartment 7. The window 61 may be constructed of dual pane thermal glass, although other types of windows are contemplated by this invention (e.g., single pane glass). A thermal mastic seal 63 around the periphery of the window 61 seals against the front wall 47 of the cabinet 41 to prevent the escape of cold air from the cold compartment 7. The window 61 is preferably immovably mounted in the front wall 47 to prevent access to the cold compartment 7 from the front of the merchandiser 1. Optionally, the front wall 47 of the merchandiser 1 may be modified to allow access to the warm and/or cold compartments, 5 and 7 respectively, from the front of the merchandiser 1. A housing 65 is provided at the front of the cabinet 41 behind the lower panel 51 of the front wall 47 for housing the refrigeration unit 15. The front wall 47 of the cabinet is preferably inclined, sloping downward and forward at an angle of about 15°, although this angle may vary, preferably within a range of 5° to 25°. The use of an inclined front wall 47 in the preferred embodiment, achieves a more attractive presentation of the products within the merchandiser 1. It will be understood that the side walls 45 and the lower panel 51 form preferred locations for advertising panels (not shown) to promote products held within the merchandiser, but other locations on the merchandiser for mounting product advertisements are also contemplated (i.e., outer surface 209).

Figure 7:
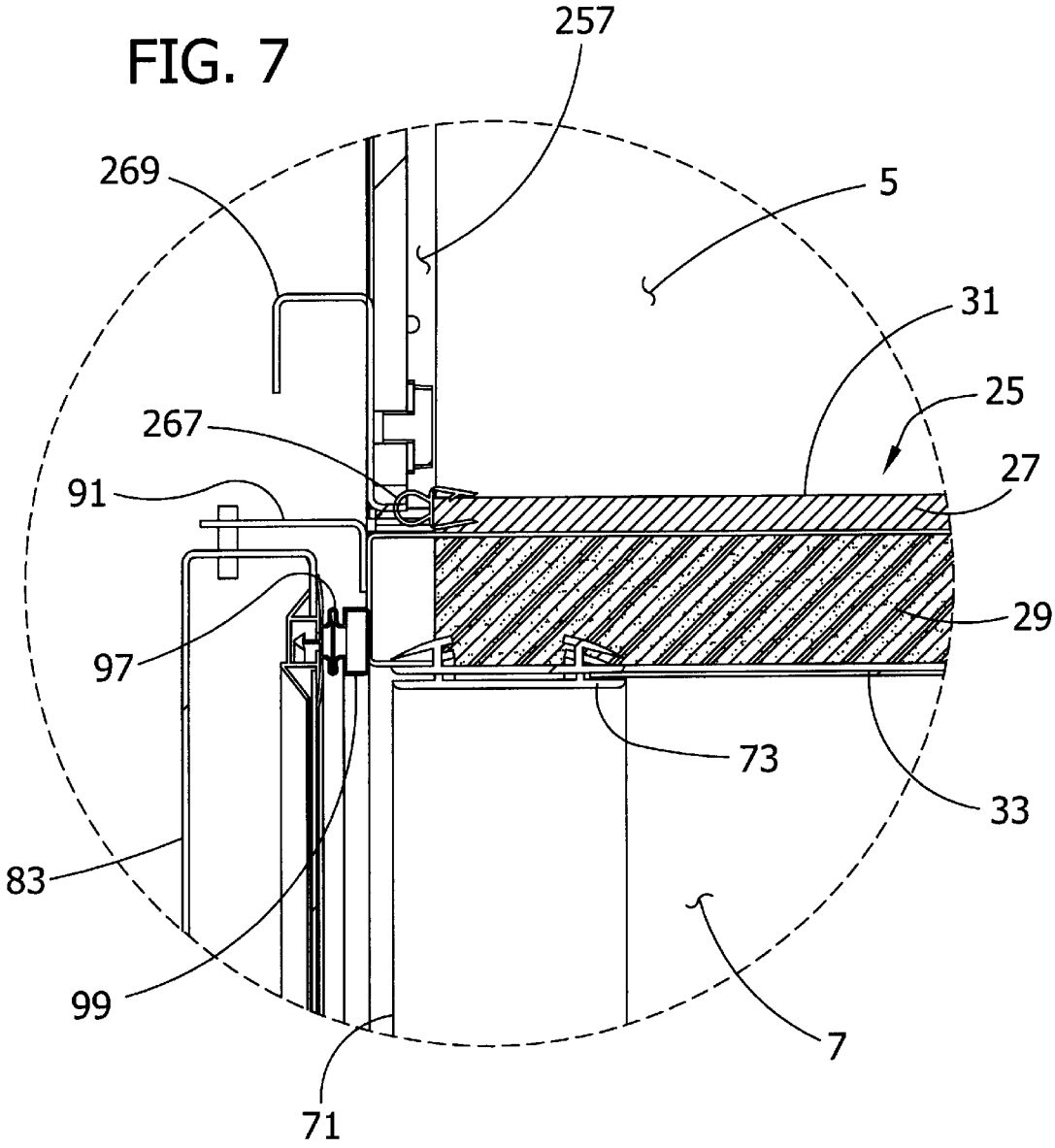
FIG. 7 is an enlarged detail view of portions of a back wall and partition of the merchandiser.

The bottom and side walls, 43 and 45 respectively, of the cabinet 41 and housing 65 for the refrigeration unit 15 are lined with a suitable thermal insulation 67, as shown in FIG. 5. This insulation may be a foam insulation, for example, sandwiched between the walls and an interior liner of stainless steel sheet metal 69, for example. A frame of insulating material 71 (e.g., PVC channel) around the cold compartment 7 at the back of the cabinet 41 provides a thermal break between the inner liner 69 and outer cabinet 41. The insulating frame 71 is secured in place by suitable means, such as snap clips 73 (FIG. 7). The back wall 81 of the cabinet 41 is defined, at least in part, by a pair of door panels 83 mounted on a vertical mullion bar 85 extending between the partition 25 and the bottom wall 43 of the cabinet. In the embodiment of FIG. 5, the back wall 81 is shown substantially perpendicular to the counter top, but it will be understood that the back wall could also be inclined towards the front of the merchandiser or otherwise configured without departing from the scope of this invention. The mullion bar 85 is preferably located generally midway between the side walls 45 of the cabinet 41 to define left and right openings of about equal area. The doors 83 are mounted on the mullion bar 85 by common top and bottom hinges, 91 and 93 respectively, that allow independent operation of each door. Rubber seals 97 mounted on the doors 83 seal against the cabinet 41 around respective openings. The doors 83 are retained in a closed position by magnets 99 (FIG. 7). It will be understood that other variations of the merchandiser 1 are contemplated that include a back wall 81 having any number of doors 83 including one or more than two. Also, a back wall 81 providing only limited access to the cold compartment 7, or that prevents access altogether, is contemplated. Further, the mullion bar 85 could be offset resulting in corresponding left and right doors 83 of unequal size.

In the embodiment shown in FIG. 5, the display section 9 and storage section 11 of the cold compartment 7 are separated by a divider 121 spaced back from and generally parallel to the transparent window 61 of the front wall 47 of cabinet 41. The divider 121 is preferably located above the housing 65 for the refrigeration unit 15, but it could also be located above the rear horizontal portion 123 of the liner 69. The divider 121 can be a partition of any suitable type, such as a grate, a vacuum formed panel having pockets for holding items to be displayed, a transparent wall, or an opaque wall. The display section 9 of the cold compartment 7 comprises the volume of space between the divider 121 and the window 61 at the front of the merchandiser 1. The storage section 11 of the cold compartment 7 comprises the volume of space between the divider 121 and the back wall 81 of the cabinet 41. The volume of the storage section 11 of the illustrated embodiment is approximately 5.0 cu. ft. and the volume of the display section 9 is approximately 0.4 cu. ft. Alternatively, the divider 121 could be omitted from the cold compartment 7, in which event the display section 9 would comprise the entire volume above the refrigeration housing 65. The storage section 11 preferably has a volume in the range of 100% to 1200% larger than the volume of the display section 9, more preferably 600% to 1500% larger, still more preferably 1000% to 1500% larger, and most preferably about 1100% to 1200% larger. Racks (not shown) are preferably used to store products in an organized fashion in the storage section 11. For example, three horizontal storage racks or shelves, vertically arranged, can be used. One or more racks or shelves (not shown) can also be installed in the display section 9 for displaying products in an attractive manner. One or more fluorescent lamps (not shown) may be attached to the bottom of the partition 25 to provide lighting for the storage section 11 and display section 9.

Figure 8:
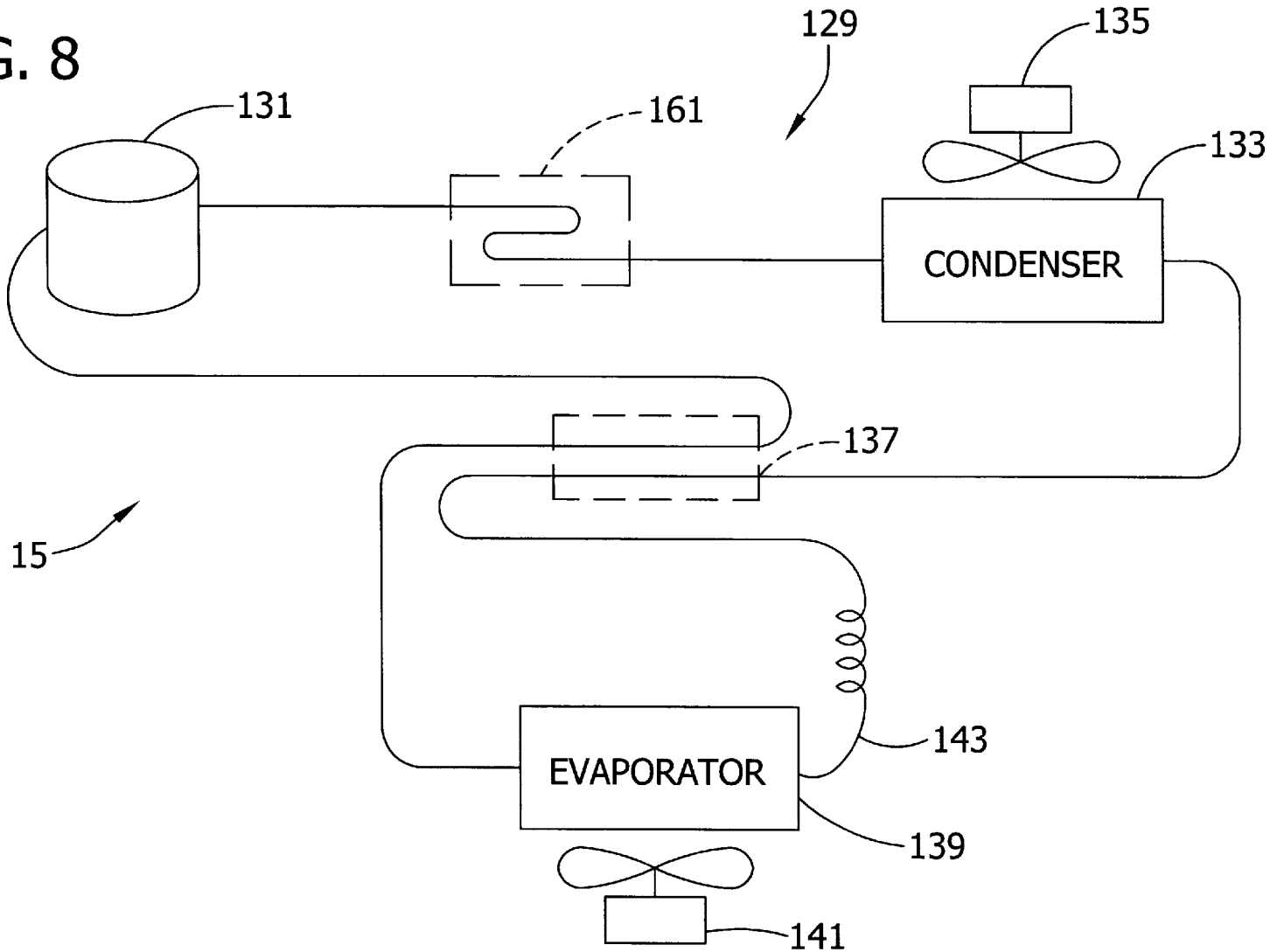
FIG. 8 is a schematic of a refrigeration circuit of the merchandiser.

FIG. 8 schematically illustrates the refrigeration unit 15. As shown, the unit comprises a conventional refrigeration circuit 129 including a compressor 131, a condenser 133, a condenser fan 135, a heat exchanger 137, an evaporator 139, an evaporator fan 141 and capillary tube 143. The unit is controlled by means of an on/off switch 151 located at the back of the merchandiser (FIG. 3). Louvers 153 in the side walls 45 of the cabinet 41 allow for the entry of ambient air into the refrigeration unit 15. Air from within the cold compartment 7 is circulated into the refrigeration unit 15 through one or more return openings 145 and passes over the evaporator coil 137 and is cooled. The colder air is then discharged from the refrigeration system 15 through one or more discharge openings 147 back into the cold compartment 7. A drip pan 161 for condensate is located directly below the refrigeration unit 15 and is removable from the merchandiser 1. The lower panel 51 at the front of the cabinet 41 is preferably removable to provide access to the refrigeration unit 15. For the sake of appearance and sanitation, a gasket 171 is provided around the bottom of the cabinet to close the gap between the cabinet and the counter top, thereby preventing debris from becoming trapped below the cabinet.

Referring to FIGS. 1–5, the warm compartment 5 of the merchandiser 1 is defined, in part, by a pair of risers 201 extending up from the side walls 45 of the cabinet 41 adjacent the rear of the cabinet. The risers 201 of the preferred embodiment are made from sheet metal but it will be understood that other materials (i.e., composites or ceramics) can be used. Each riser 201 is secured to the cold compartment cabinet 41 by conventional fasteners (e.g., rivets, not shown) and has a flange 203 along its front vertical edge 205 projecting forward in a plane which is offset inward from the plane of the outer surface 209 of the riser (FIG. 5). A housing 221 for the heating unit 13 is attached to the risers 201 by screws 223 or the like in a position spaced above the horizontal partition 25. The housing 221 has top and back walls, 225 and 227 respectively, that further define the warm compartment 5. As will be described later in more detail, the heating unit 13 is similar to that disclosed in U.S. Pat. No. 6,257,010 and functions to circulate warm air throughout the warm compartment 5. One or more incandescent lamps (not shown) are attached to one or both of the risers 201 inside the warm compartment 5 to illuminate products within the warm compartment for viewing.

In one embodiment, the warm compartment 5 is further defined by a pair of side panels 235 which are secured to respective flanges 203 of the risers 201 by suitable fasteners 237 (e.g., screws) and which extend forward from the risers to the front of the merchandiser 1. The thickness of the side panels 235 generally corresponds to the inward offset of the flanges 203 so that, when assembled, the outer surfaces 209 of each riser 201 and respective side panel are generally coplanar to enhance attractiveness and to provide smooth joints. The side panels 235 are bridged by a cover panel 241 which extends over the warm compartment 5. Preferably, the side panels 235 and cover panel 241 are transparent to allow viewing of products within the warm compartment 5. In the illustrated embodiment these panels 235 and 241 are fabricated as a single piece of molded plastic (e.g., acrylic) but it will be understood that other materials (i.e., glass) and constructions can be used. The cover panel 241 is preferably formed to have a substantially horizontal rear portion 243 which is generally coplanar with the top of the heater housing 225, an inclined generally planar front portion 245 defining the front of the warm compartment 5, and a curved portion 247 joining the front and rear portions. In the illustrated embodiment the curved portion 247 of the cover panel has a radius of curvature of about 8 inches, but it will be understood that this radius may vary. In the preferred embodiment, the inclined front portion 245 of the cover panel 241 is substantially coplanar with the front wall 47 of the cabinet 41 defining the cold compartment 7. Access to the warm compartment 5 is provided by a door 255 closing an opening 257 at the back of the merchandiser 1 between the heater housing 221 and the partition 25. When closed, the door 255 defines the back of the warm compartment 5 (FIG. 5). In one embodiment, the door 255 is mounted for pivoting about a generally horizontal axis between open and closed positions by a pair of hinges 261 attached to the heater housing 221. When closed, the door 255 seals against a rubber seal 267 secured to the partition 25 and to the risers 201. A handle 269 is provided for swinging the door 255 open and closed.

Figure 6:
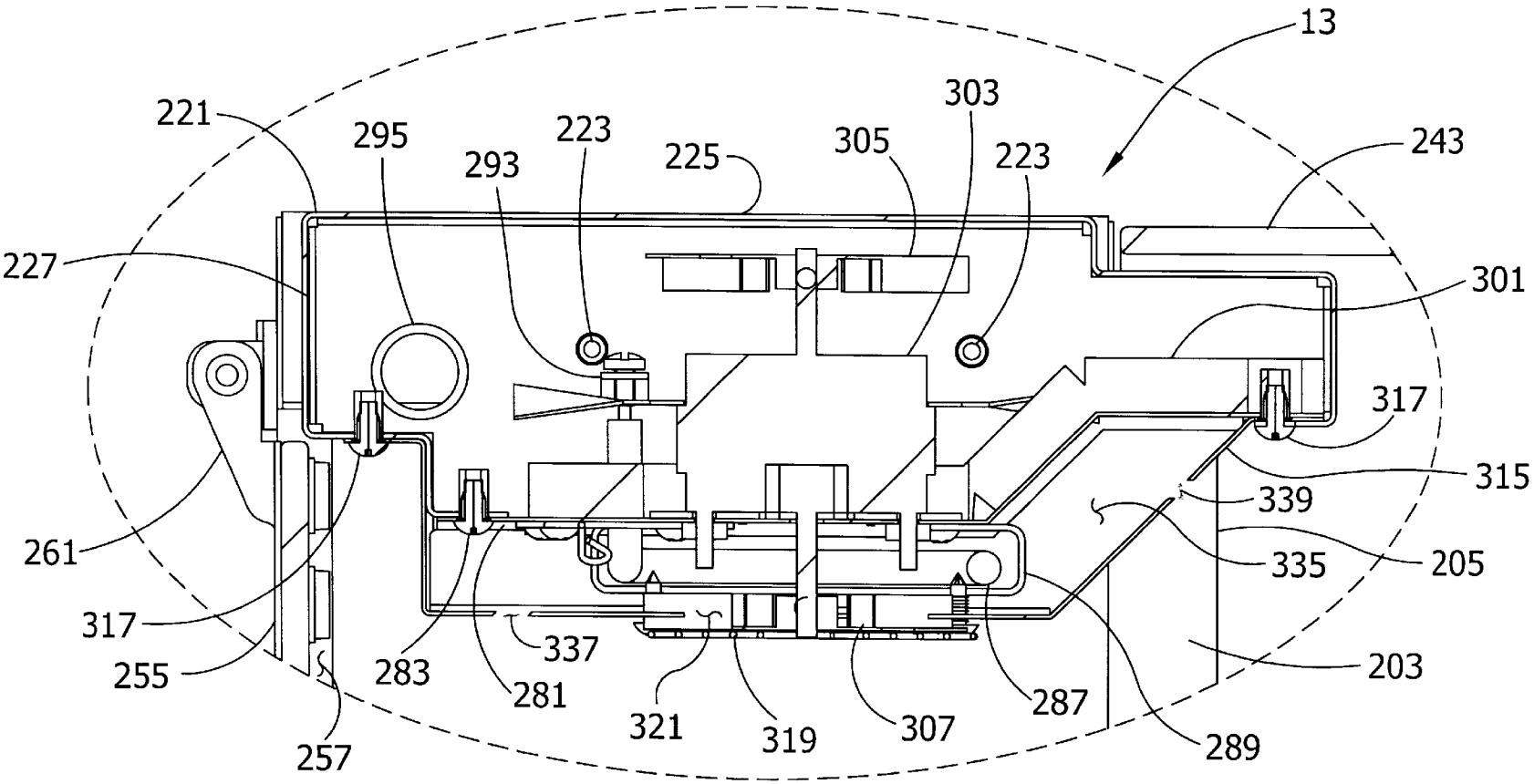
FIG. 6 is an enlarged detail view of a heating unit of the merchandiser.

FIG. 6 illustrates the preferred heating unit 13 which, as previously noted, may be similar to that disclosed in U.S. Pat. No. 6,257,010. The unit 13 is disposed in the housing 221 and includes a horizontal mounting plate 281 affixed by screws 283 or other suitable means to the housing 221. A heating element 287 is secured, as by wire clips 289, to the mounting plate 281 in a position below the plate. Electric current is provided to a terminal 293 of the heating element 287 via wiring (not shown) entering the housing 221 through an annular bushing 295 in one wall of the housing. A layer of thermal insulation 301 is provided above the mounting plate 281. The unit also includes a motor 303 driving an upper fan 305 above the mounting plate 281 and a lower fan 307 below the heating element 287, the lower fan being rotatable to circulate air from the warm compartment 5 over the heating element and to discharge the heated air back into the warm compartment, and the upper fan being rotatable for cooling the motor. The motor 303 is preferably a single-speed dc motor. The electric heating element 287 and lower fan 307 are enclosed by a cover 315 removably secured to the housing 221 by suitable fasteners 317, and by a mesh guard screen 319 over an opening 321 in the cover around the lower fan 307. The cover 315 and mounting plate 281 combine to define an air plenum 335. The lower fan 307 forces air out of the plenum 335 through the lower guard screen 319 and slots 337 in the bottom of the lower cover 315 creating a slight negative pressure in the plenum. The negative pressure created by the lower fan 307 pulls air into the plenum 335 through gaps 339 in the cover. The air entering the plenum 335 flows across the heating coil 287 and exits the plenum through the cover 315 and guard screen 319. The heating unit 13 is controlled via a thermostat control knob 345 located at the back of the merchandiser 1 (FIG. 3).

Figure 9:
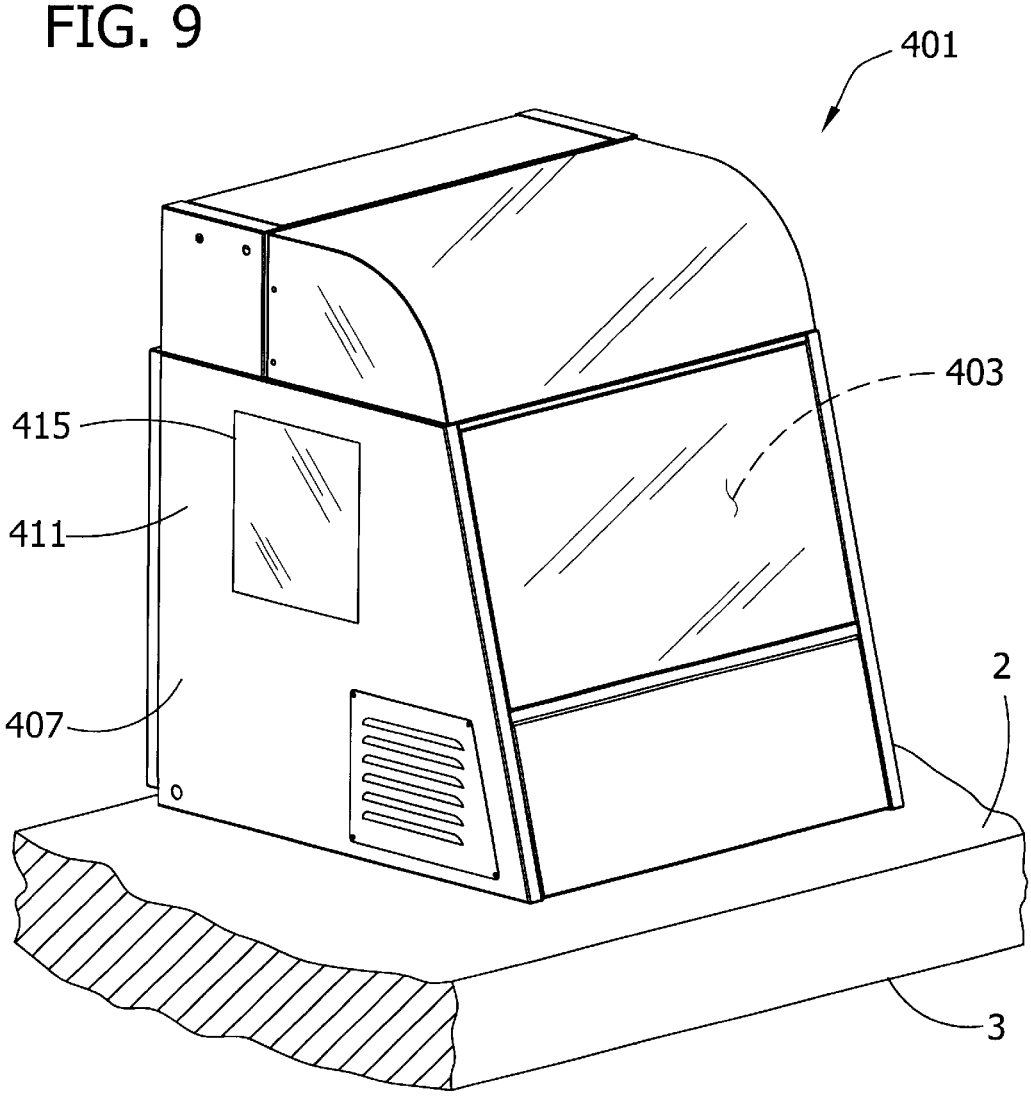
FIG. 9 is a left-side perspective view showing a second embodiment of the merchandiser.
Figure 10:
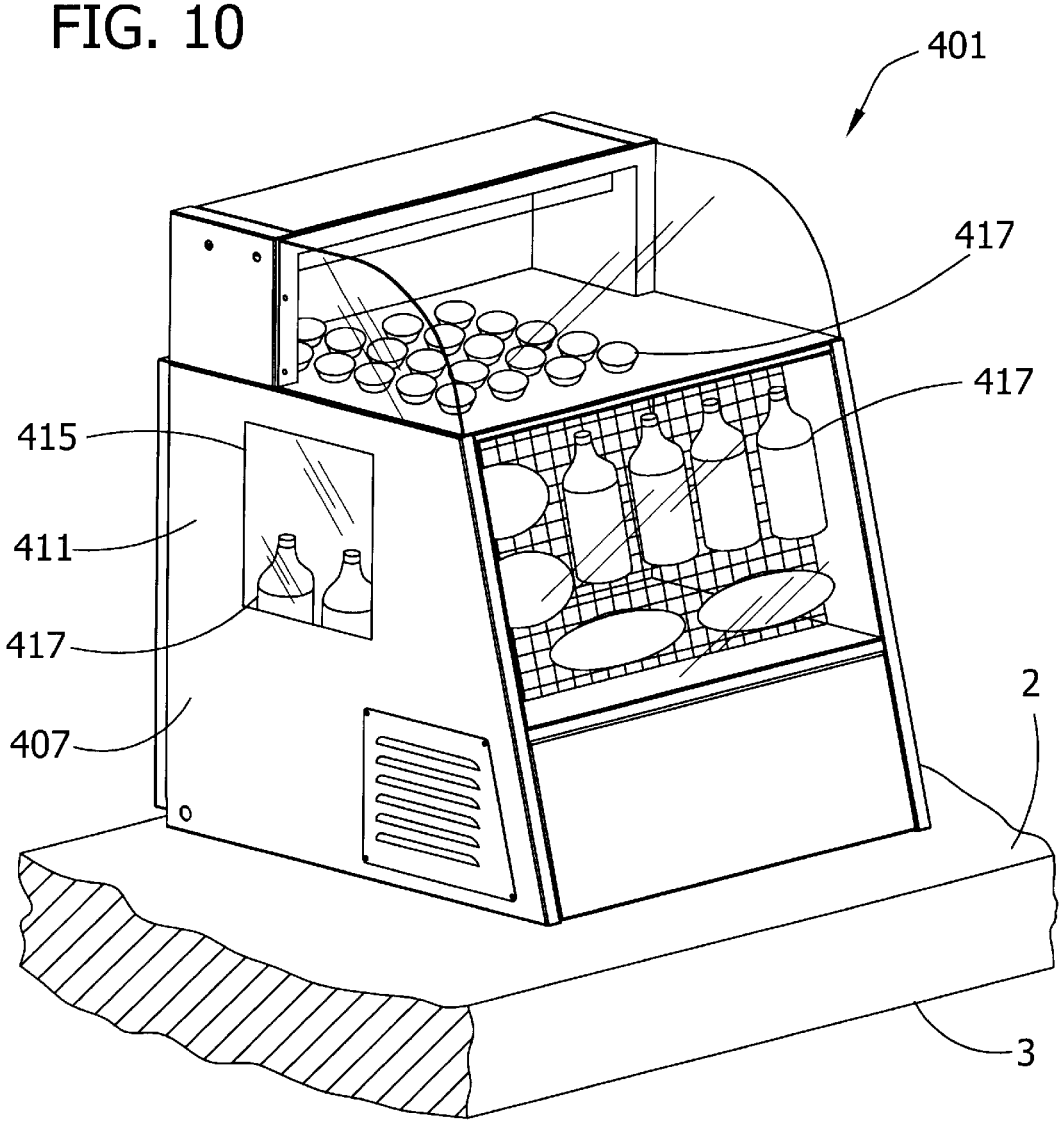
FIG. 10 is a left-side perspective view showing products displayed in the second embodiment of the merchandiser.

Other types of heating systems can be used to heat products within the warm compartment 5. For example, radiant heaters, infrared heaters, or other systems can be used. FIGS. 9 and 10 illustrate a second embodiment of a counter top merchandiser of the present invention, generally designated 401. This embodiment is substantially similar to the first embodiment. The cold compartment of this merchandiser is generally designated 403 and is defined by a cabinet 407 of sheet metal substantially similar to the cabinet 41 of the first embodiment. In this embodiment, the side walls 411 of the cabinet 407 include windows 415 that allow viewing of products 417 in the cold compartment 403 of the merchandiser 401.

Figure 11:
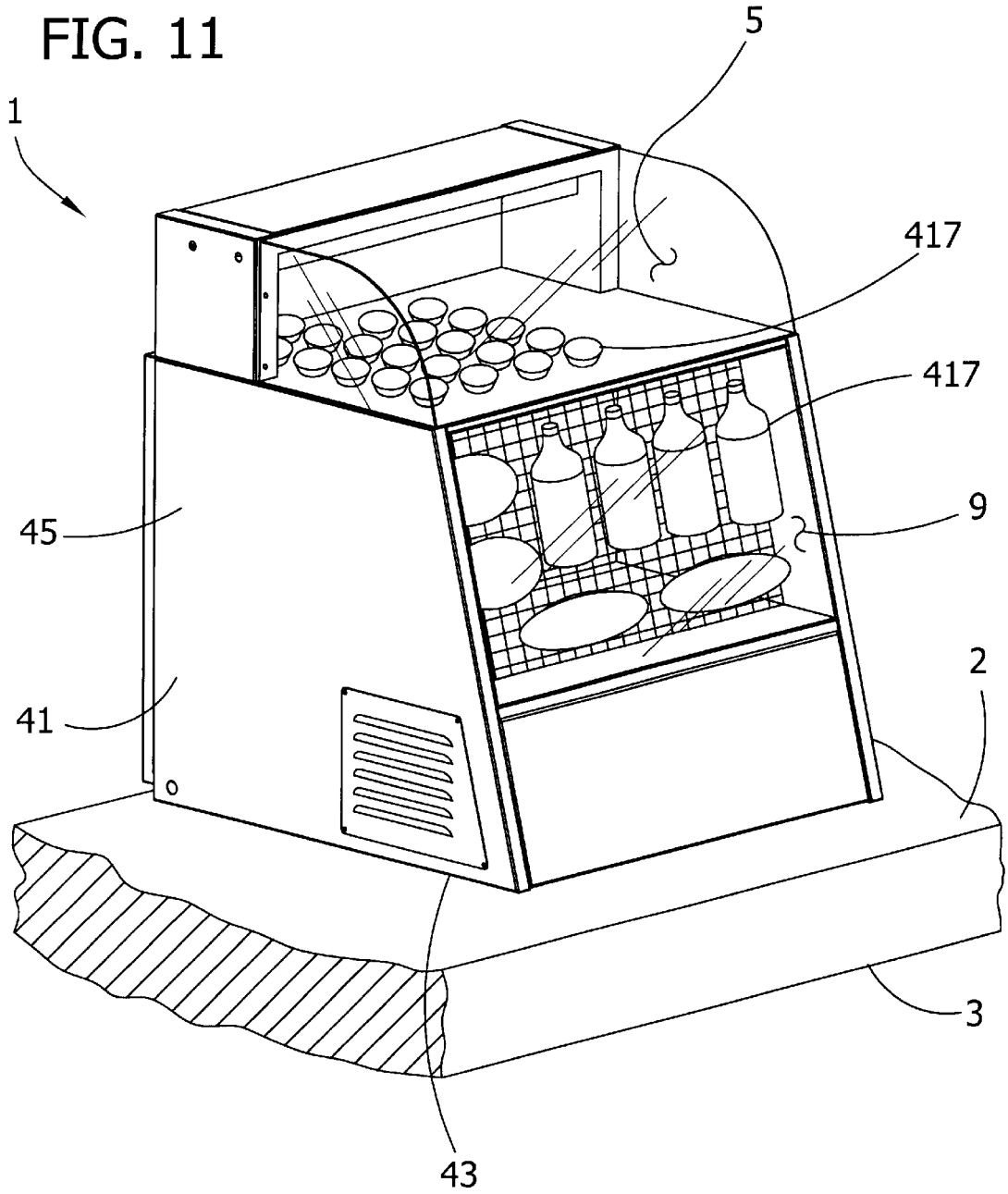
FIG. 11 is a left-side perspective view showing products displayed in the first embodiment of the merchandiser.

In use, the merchandiser 1, is placed with its bottom wall 43 resting on the top surface 2 of the counter top 3. It is then loaded with products to be stored and displayed. One such product is food, but it will be understood that other types of products may also be stored and displayed in the merchandiser 1. FIG. 11 illustrates exemplary food products 417 (e.g., drinks, salads, pies, cookies, etc.) that can be stored and displayed in the merchandiser 1. The heating unit 13 elevates the temperature within the warm compartment 5 and the refrigeration unit 15 decreases the temperature within the cold compartment 7 below ambient temperature.

The top access door 255 is opened so that products to be warmed can be placed in the warm compartment 5. The products in the warm compartment 5 are viewed by customers through the transparent side and cover panels 235 and 241, and are removed by a merchant upon customer purchase. Cold products are placed in the cold compartment 7 through the left and/or right lower doors 83 of the merchandiser 1. Preferably, representative samples of display items are placed in the display section 9. These items can be attached to the divider 121, placed on one or more racks or shelves, placed in vacuum formed panels or otherwise positioned for attractive display to prospective customers. Alternatively, display items may be placed on the forward horizontal section 125 of the lower liner 43 above the housing 65 for the refrigeration unit 15. The cold products in the display section 9 can be viewed by prospective customers through the transparent window 61. Additional quantities of cold products shown in the display section 9 are placed in the storage section 11 as inventory that is easily removable from the merchandiser 1 upon purchase. The left and right lower doors 83 provide independent access to the back of the cold compartment 7 so that cold products can be removed from the merchandiser 1 by attendants serving customers from both sides of the merchandiser.

Figure 12:
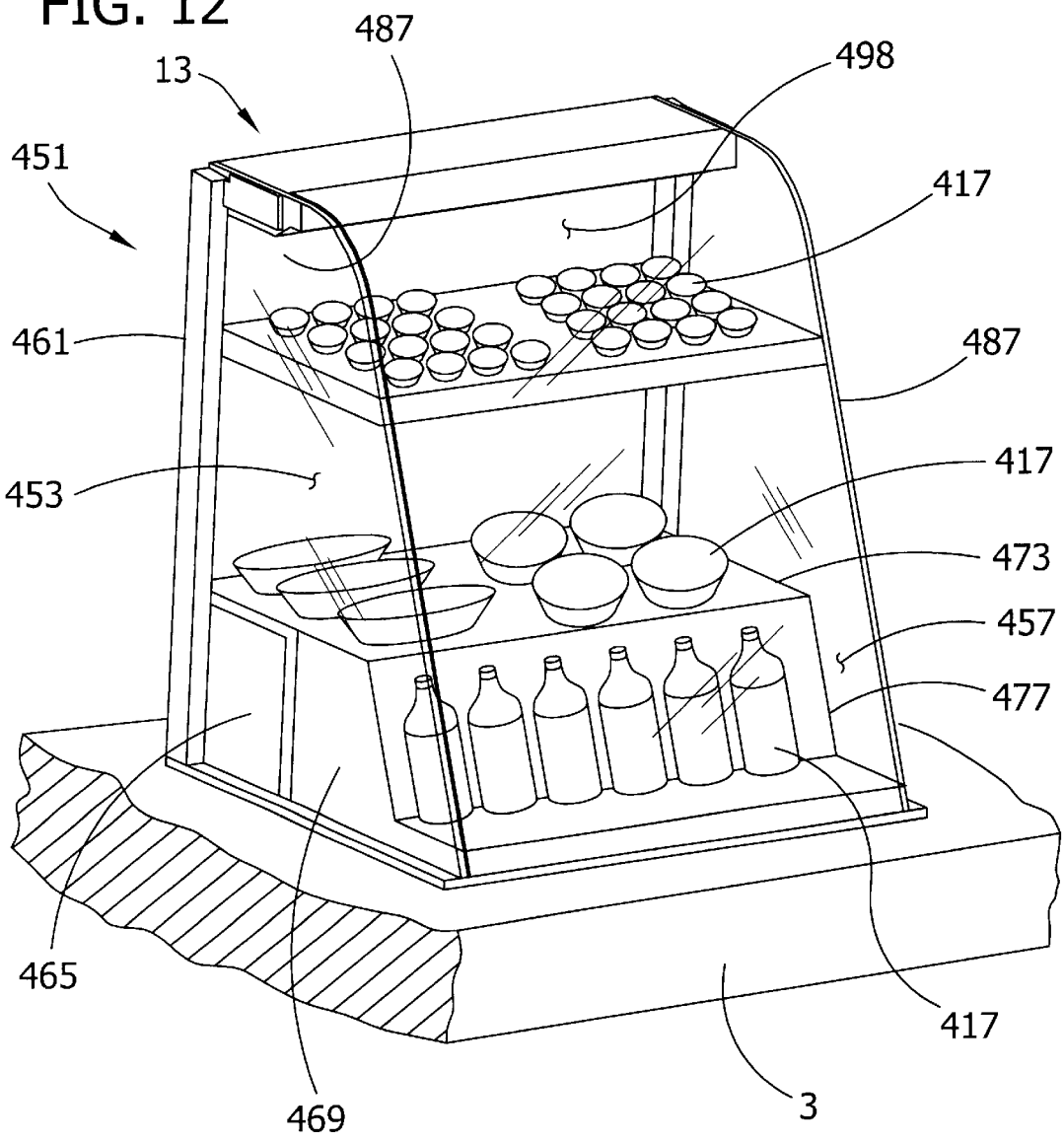
FIG. 12 is a left-side perspective view of a counter top hot/cold merchandiser of a third embodiment of the present invention.
Figure 13:
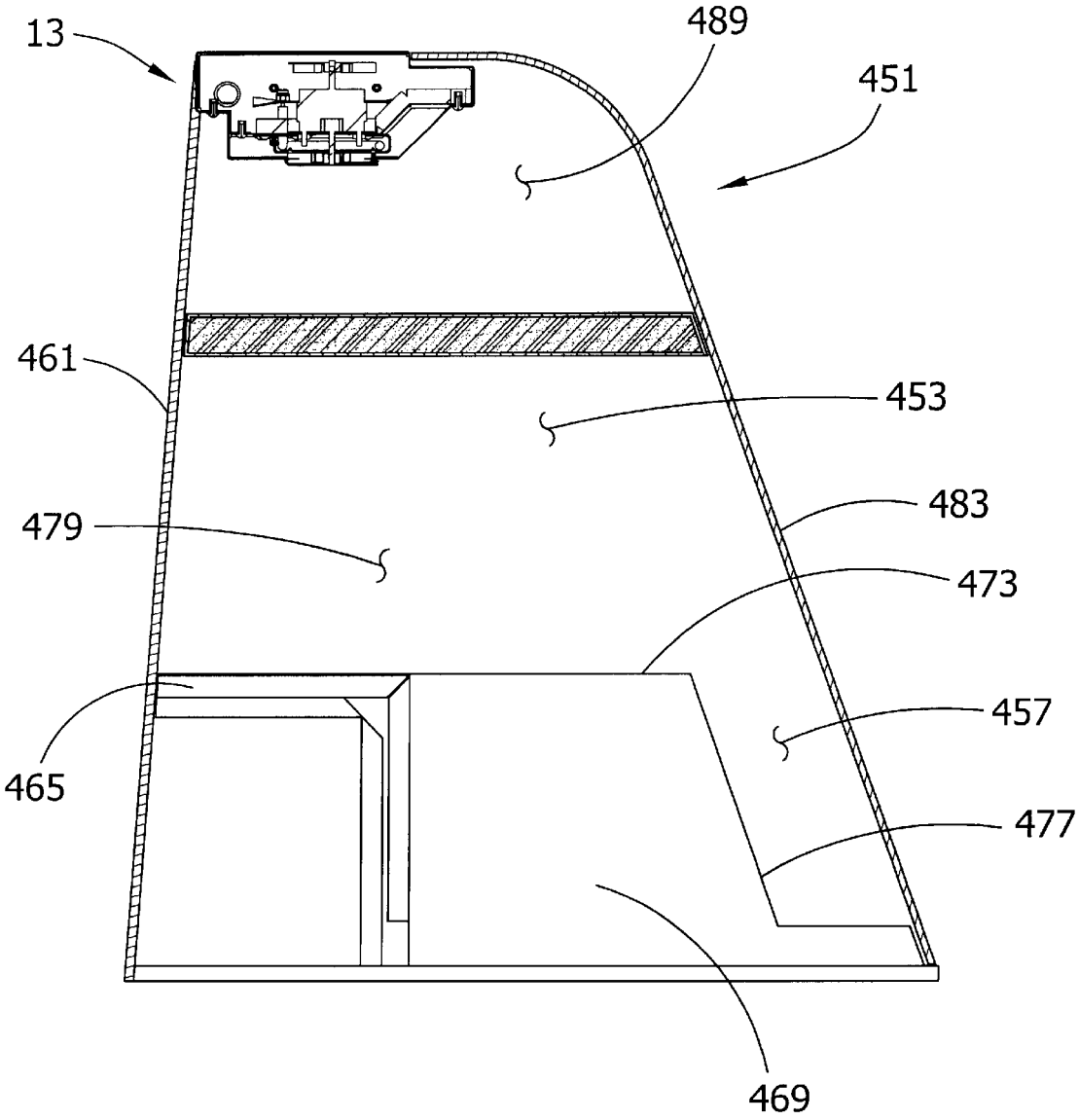
FIG. 13 is a sectional view of the third embodiment.

FIGS. 12 and 13 illustrate a third embodiment of a counter top merchandiser of the present invention, generally designated 451. This embodiment 451 is substantially similar to the first embodiment 1 except the cold compartment 453 is configured to provide a larger front display section 457. As seen in FIG. 13, the merchandiser 451 has an inclined back wall 461 and a bottom housing 465 in the cold compartment 453 adjacent the back wall of the merchandiser for housing the refrigeration unit 15. A bottom bench 469 is provided adjacent the housing 465 comprising a top wall 473 substantially planar with the top of the housing and an inclined front wall 477. The bench 469 is configured so that products 417 placed in the rear storage section 479 of the cold compartment 453 that are supported by the housing 465 and the top wall 473 of the bench have a neat and organized appearance and are readily accessible from the rear of the merchandiser 451. The front display section 457 of this embodiment 451 is located at the bottom of the cold compartment 453 and includes the space between the inclined front wall 477 of the bench 459 and the inclined front wall 483 of the merchandiser 451. As in the previous embodiment, a divider or racks (not shown) for holding products 417 in the display section 457 may be arranged so that products are displayed in an organized fashion near the front of the cold compartment 453.

In the embodiment of FIGS. 12 and 13, the merchandiser 451 has integral (one-piece) side walls 487 that define the sides of the cold compartment 453 and the warm compartment 489. Also, the front wall 483 of the merchandiser 451 is an integral (one-piece) wall defining the front of the warm and cold compartments 453, 489 to enhance attractiveness and eliminate joints. It will be understood that the side walls 487 and front wall 483 of the merchandiser 451 may be made from a single piece of transparent molded plastic (e.g., acrylic) or thermal glass so that products 417 within the merchandiser can be viewed from a variety of angles. Alternatively, the merchandiser 451 of this embodiment could have one or more distinct side wall(s) and/or front wall(s) without departing from the scope of this invention.

Figure 14:
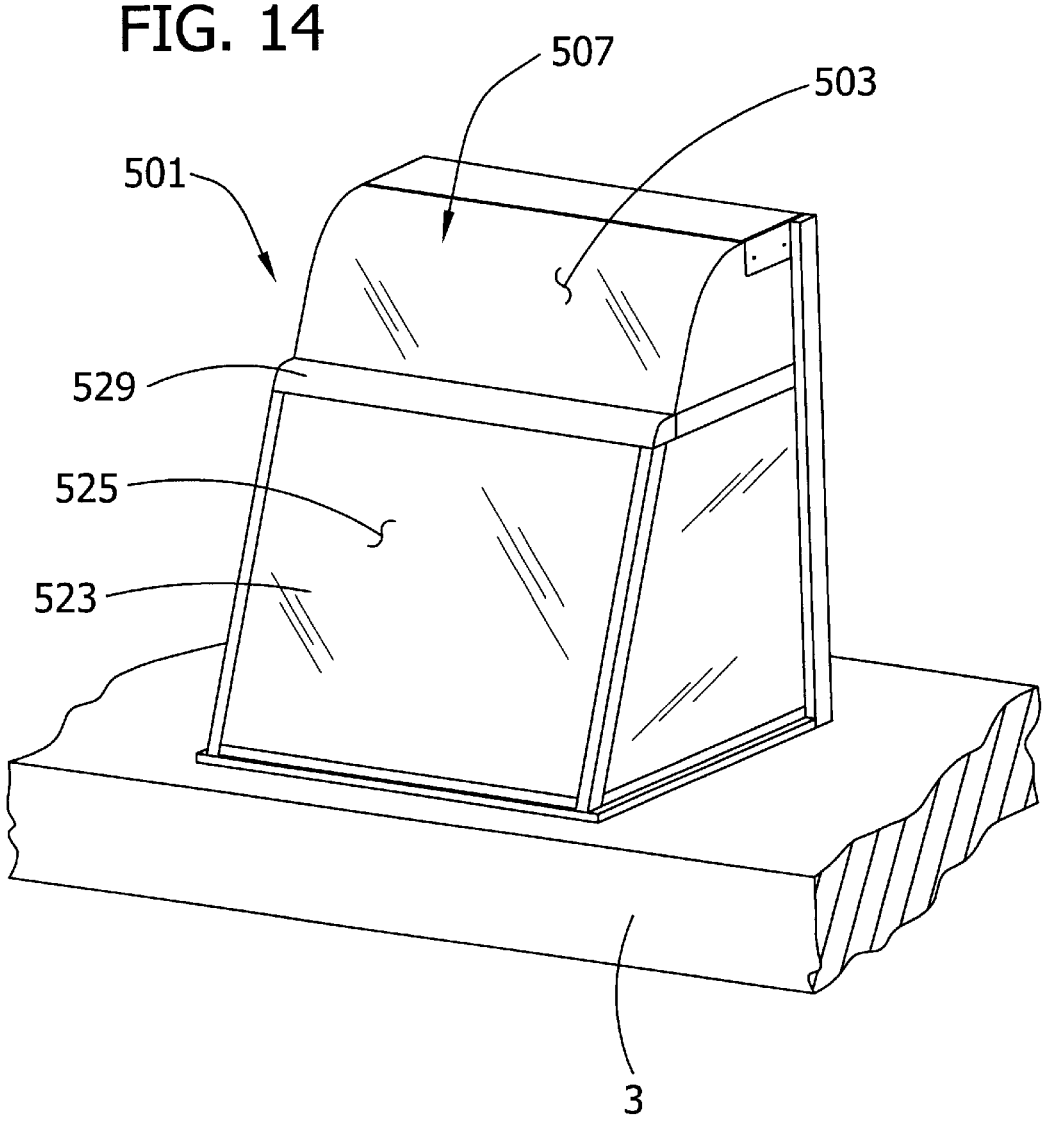
FIG. 14 is a right-side perspective view of a counter top hot/cold merchandiser of a fourth embodiment.
Figure 15:
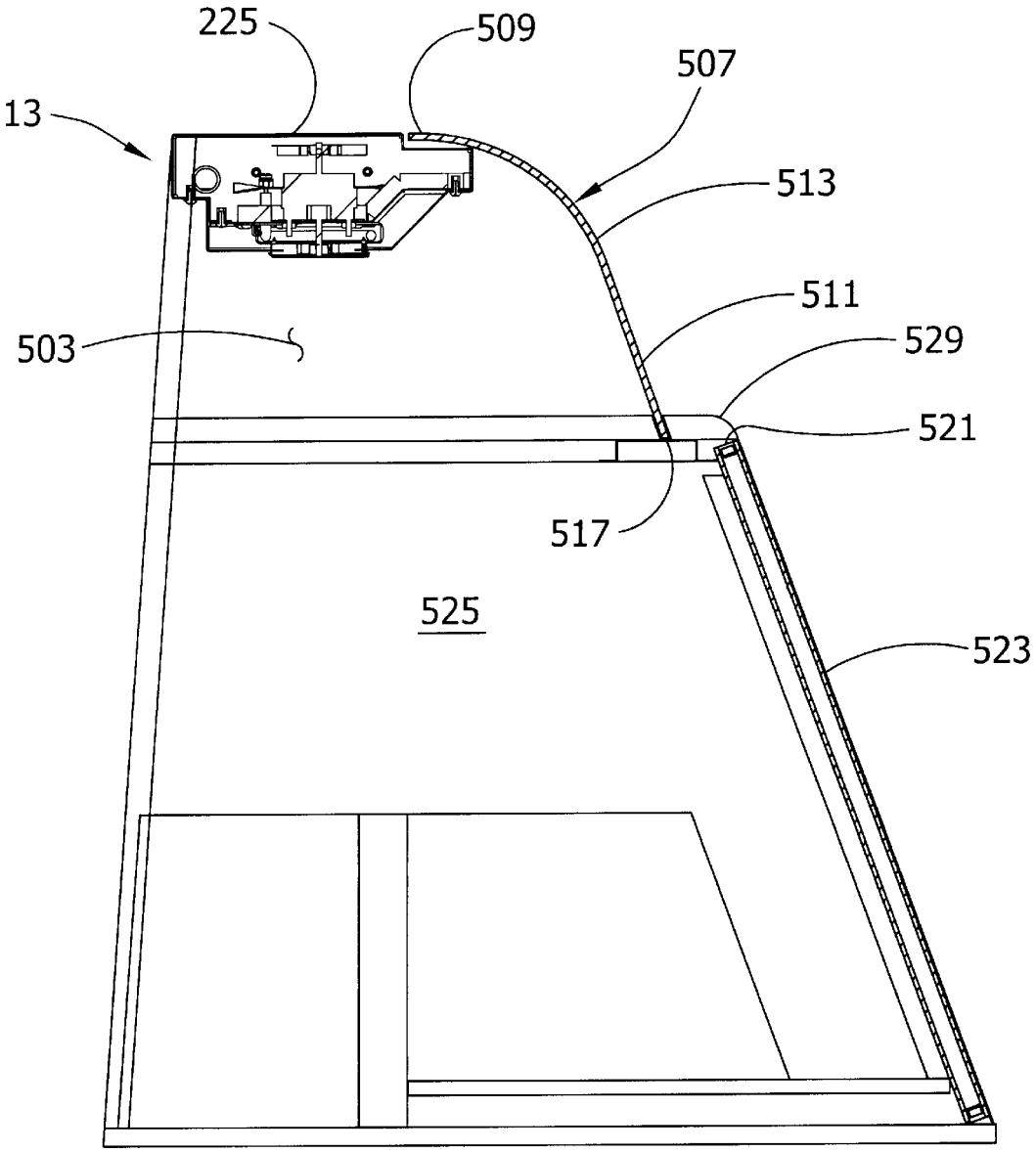
FIG. 15 is a sectional view of the fourth embodiment.

FIGS. 14 and 15 show a fourth embodiment of a counter top merchandiser of the present invention generally designated 501. This embodiment is substantially similar to the third embodiment 451 but includes a modified warm compartment 503. The warm compartment 503 is defined by a cover panel, generally designated 507, that has a short rear section 509 substantially coplanar with the top of the heater housing 225, an inclined generally planar front section 511 defining the front of the warm compartment, and a curved section 513 joining the front and rear sections. As seen in FIG. 15, the inclined front section 511 of the cover panel 507 has a lower edge 517 located inward from the top edge 521 of the front wall 523 of the cold compartment 525. A cover 529 is mounted at the front of the merchandiser 501 to provide a smooth transition surface between the front wall 523 and the cover panel 507. Also, the cover 529 is particularly useful for displaying advertisements (not shown) or other information at the front of the merchandiser 501.

Figure 16:
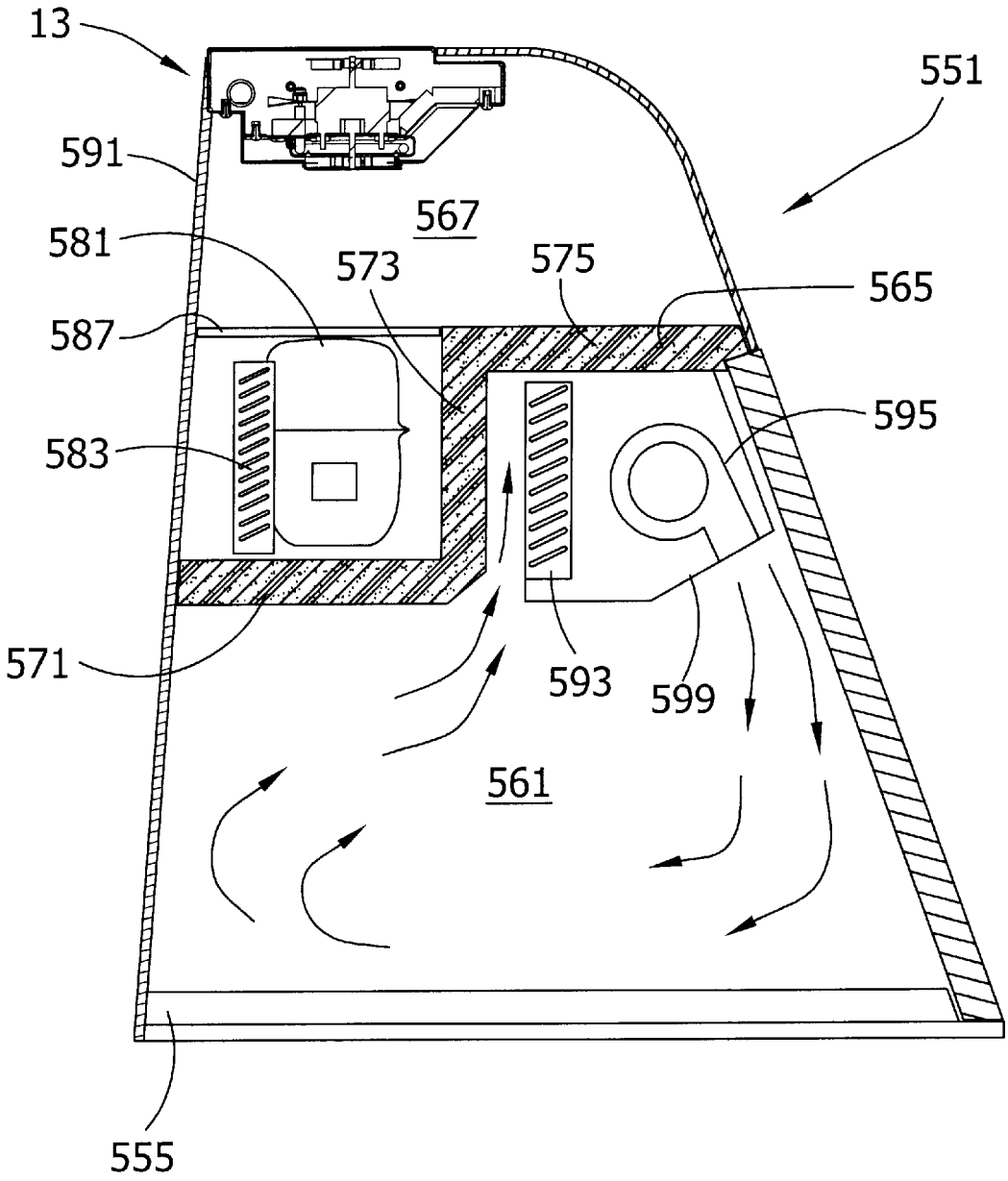
FIG. 16 is a sectional view of a counter top hot/cold merchandiser of a fifth embodiment.

FIG. 16 shows a fifth embodiment of a counter top merchandiser of the present invention generally designated 551. This embodiment is substantially similar to the earlier embodiments except the refrigeration system is spaced above the bottom wall 555 of the cold compartment 561. As seen in FIG. 16, the partition 565 separating the warm compartment 567 and the cold compartment 561 has a lower horizontal portion 571, a vertical portion 573 and an upper horizontal portion 575. The compressor 581 and condenser 583 of the refrigeration system are housed on the top surface of the lower horizontal portion 571 of the partition 565 and are enclosed below the warm compartment 567 by a removable cover plate 587 that is affixed to the upper horizontal portion 575 of the partition and the back wall 591 of the merchandiser. The evaporator 593 and evaporator fan 595 are housed in an enclosure 599 fixedly attached to the underside of the upper horizontal portion 575 of the partition 565 by conventional means (e.g., welding or threaded fasteners) adjacent the top of the cold compartment 561 of the merchandiser 551. The evaporator fan 595 pulls air into the enclosure 599 from the cold compartment 561 and discharges air that has been cooled by the evaporator 593 so that the cold compartment remains cool. It will be understood that the refrigeration unit 553 also includes tubing (not shown) that is routed between the condenser and evaporator to allow refrigerant to flow between the components of the refrigeration system.

Figure 17:
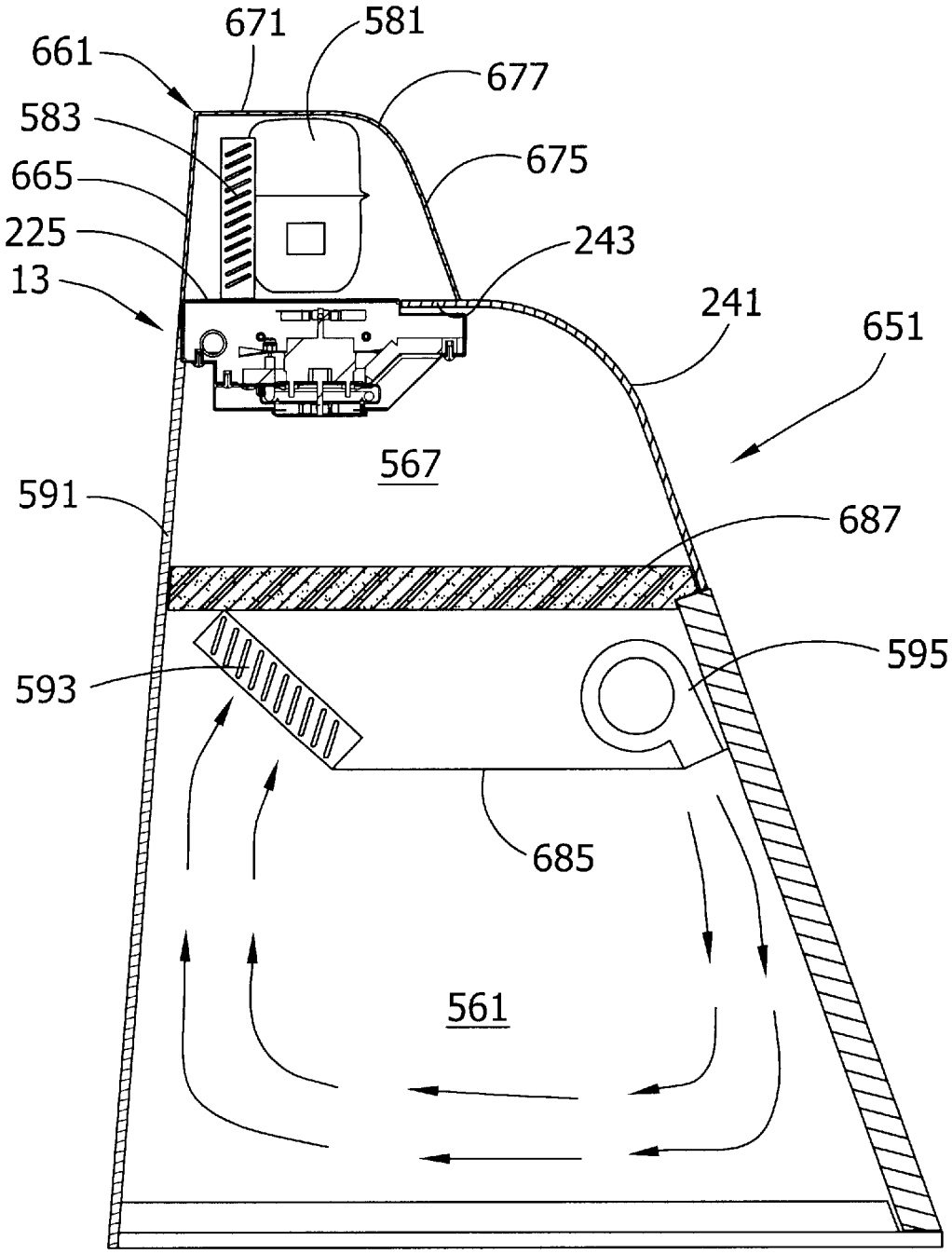
FIG. 17 is a sectional view of a counter top hot/cold merchandiser of a sixth embodiment.

FIG. 17 shows a sixth embodiment of a counter top merchandiser of the present invention generally designated 651. This embodiment is substantially similar to the fifth embodiment 551 except that the compressor 581 and condenser 583 of the refrigeration system are mounted above the warm compartment 567 of the merchandiser. The merchandiser 651 of this embodiment includes a top enclosure, generally designated 661, that houses the compressor 581 and condenser 583 of the refrigeration system 553 and is mounted on the top wall 225 of the heating unit 13 and the horizontal rear portion 243 of the cover panel 241. The top enclosure 661 has a back wall 665 substantially planar with the back wall 591 of the merchandiser 651, a top wall 671 defining the top of the merchandiser, a substantially planar inclined front wall 675 defining the front of the enclosure, and a rounded intermediate portion 677 connecting the top wall and inclined front wall. It will be understood that the top enclosure 661 can have other shapes and configurations without departing from the scope of this invention. For example, the inclined front wall of the enclosure 661 could be substantially planar with the inclined portion 245 of the cover panel 241 of the warm compartment 567.

As seen in FIG. 17, the evaporator 593 and evaporator fan 595 of this embodiment 651 are housed in a middle enclosure 685 fixedly attached to the bottom of the partition 687 separating the cold compartment 561 and the warm compartment 567. As in the fifth embodiment 551, air from the cold compartment 561 may be cooled by circulation over the evaporator 593 housed in the enclosure 685. It will be understood that this embodiment also includes tubing (not shown) that is routed from the condenser 583 and compressor 581 in the top enclosure 661 to the evaporator 593 in the middle enclosure 685 so that refrigerant may be exchanged between the components of the refrigeration system.

Figure 18:
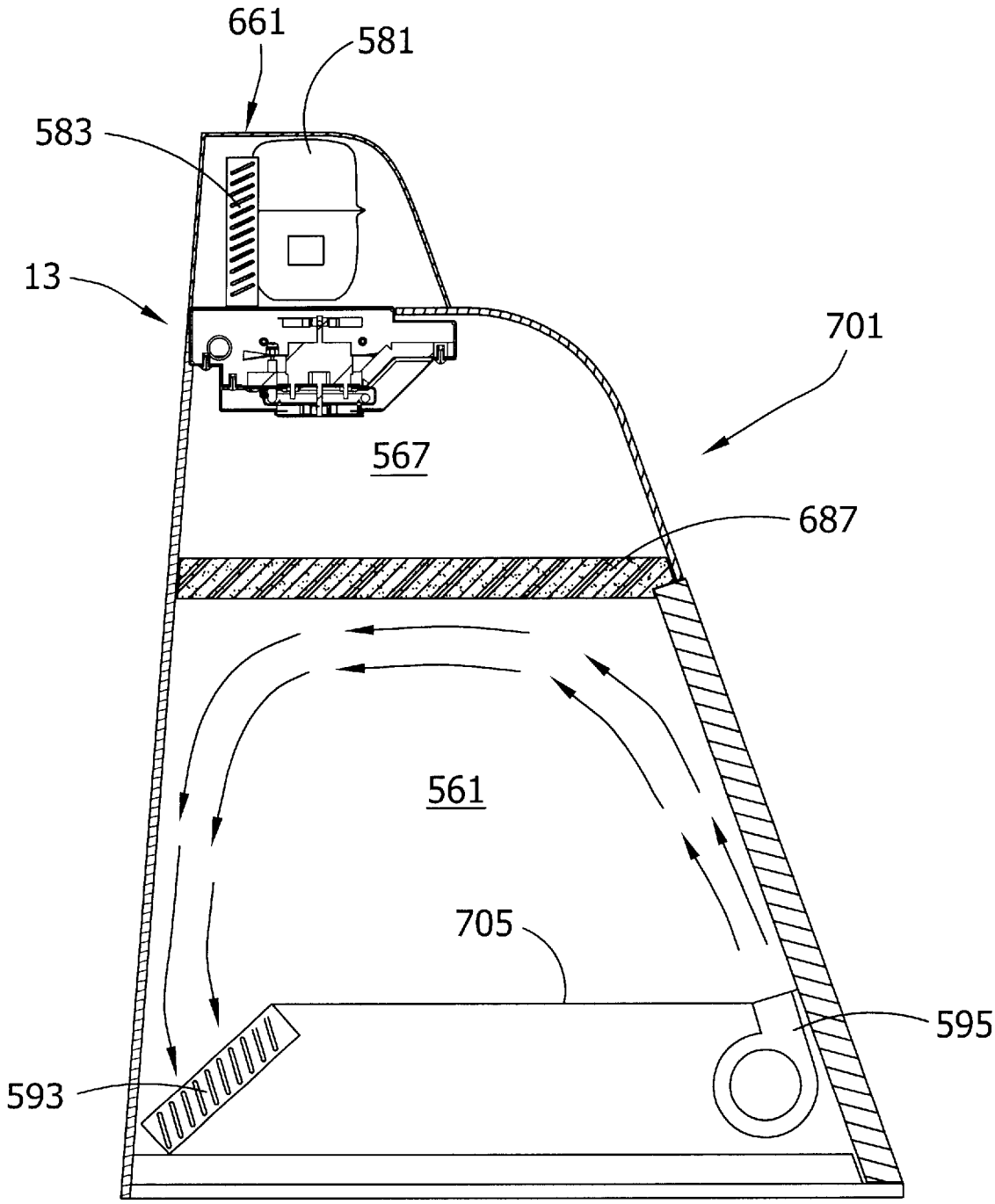
FIG. 18 is a sectional view of a counter top hot/cold merchandiser of a seventh embodiment.

FIG. 18 shows a seventh embodiment, generally designated 701, that is substantially similar to the sixth embodiment 651 except that the evaporator 593 and evaporator fan 595 are located in an enclosure 705 at the bottom of the cold compartment 561. It will be understood that refrigeration system may have other designs including those in which the evaporator 593 and evaporator fan 595 are more compactly arranged so that the enclosure 705 occupies less space in the cold compartment 561. An alternative design having a more compact enclosure 705 with a cold compartment 561 configured with a larger front display section as in the embodiment of FIG. 13 is within the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. For example, the shape and construction of the walls of the merchandiser may vary. Further, the size and location of the access doors and heating and refrigeration units may vary. The relative sizes of the display and storage sections of the cold compartment may also vary although typically the storage section will be substantially larger than the display section. Selected walls of the merchandiser may be used to display advertising, if desired.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A counter top merchandiser for holding and displaying hot and cold products, said merchandiser comprising:

a warm compartment within the merchandiser for holding and displaying warm products;

a cold compartment below the warm compartment and defined in part by a bottom wall positioned above the counter top when the merchandiser is placed on the counter top, said cold compartment having a display section and a storage section;

a partition separating the warm and cold compartments;

a heating unit for heating products within the warm compartment;

a refrigeration unit for cooling products within the cold compartment;

at least one transparent wall to allow viewing of products within the merchandiser; and openings providing access to the warm and cold compartments from a rear of the merchandiser.

2. A merchandiser as set forth in claim 1 further comprising a divider separating the display and storage sections of the cold compartment.

3. A merchandiser as set forth in claim 1 further comprising a housing for said refrigeration unit below said display section of the cold compartment.

4. A merchandiser as set forth in claim 1 further comprising a housing for said refrigeration unit below said storage section of the cold compartment.

5. A merchandiser as set forth in claim 3 wherein said cold compartment is defined by a cabinet having a front wall comprising a removable lower panel providing access to said refrigeration unit.

6. A merchandiser as set forth in claim 1 wherein the cold compartment is defined in part by a cabinet having at least one transparent wall.

7. A merchandiser as set forth in claim 6 wherein the warm compartment is defined in part by risers extending up from opposite sides of the cabinet adjacent the rear of the merchandiser and a housing for the heating unit supported on the risers, said heating unit comprising a fan located in the housing for withdrawing air from the warm compartment and discharging it back into the warm compartment, and a heating element in the housing for heating the air withdrawn from the warm compartment.

8. A merchandiser as set forth in claim 1 wherein the cold compartment is defined in part by an inclined front wall having a window therein for viewing products in the display section.

9. A merchandiser as set forth in claim 8 wherein the warm compartment is defined in part by a cover panel having an inclined portion generally coplanar with said inclined front wall.

10. A merchandiser as set forth in claim 1 wherein said display section is toward a front of the merchandiser and said storage section is toward a rear of the merchandiser.

11. A merchandiser as set forth in claim 10 wherein said display section is located at the bottom of the cold compartment.

12. A merchandiser as set forth in claim 1 wherein said storage section is at least 600% larger in volume than said display section.

13. A merchandiser as set forth in claim 1 wherein the cold compartment is defined in part by a front wall at least a portion of which is transparent to allow viewing of products within the merchandiser.

14. A merchandiser as set forth in claim 1 wherein the warm compartment is defined in part by at least one transparent wall.

15. A merchandiser as set forth in claim 1 wherein the cold compartment is defined in part by at least one door at the rear of the merchandiser providing access to the cold compartment.

16. A merchandiser as set forth in claim 15 where the warm compartment is defined in part by at least one door at the rear of the merchandiser for providing access to the warm compartment.

17. A merchandiser as set forth in claim 1 wherein said refrigeration system comprises a compressor, condenser, and evaporator housed within the merchandiser.

18. A merchandiser as set forth in claim 17 wherein said compressor and condenser are housed above said partition and said evaporator is housed below the partition.

19. A merchandiser as set forth in claim 18 wherein said compressor and condenser are housed above said warm compartment.

20. A merchandiser as set forth in claim 18 wherein said evaporator is housed adjacent a top of said cold compartment.

21. A merchandiser as set forth in claim 18 wherein said evaporator is housed at a bottom of said cold compartment.

22. A counter top merchandiser for holding and displaying hot and cold products, said merchandiser comprising:

a bottom wall positioned above the counter top when the merchandiser is placed on the counter top, a warm compartment within the merchandiser above the bottom wall for holding and displaying warm products;

a cold compartment within the merchandiser above the bottom wall having a display section and a storage section;

a partition separating the warm and cold compartments;

a heating unit for heating products within the warm compartment;

a refrigeration unit for cooling products within the cold compartment;

at least one transparent wall to allow viewing of products within the merchandiser; and the warm and cold compartments being accessible from a rear of the merchandiser.

23. A merchandiser as set forth in claim 22 further comprising a divider separating the display and storage sections of the cold compartment.

24. A merchandiser as set forth in claim 22 wherein said display section is toward a front of the merchandiser and said storage section is toward the rear of the merchandiser.

25. A merchandiser as set forth in claim 22 wherein said storage section is at least 600% larger in volume than said display section.

26. A merchandiser as set forth in claim 22 wherein said refrigeration system comprises a compressor, condenser, and evaporator housed within the merchandiser.

27. A merchandiser as set forth in claim 26 wherein said compressor and condenser are housed above said partition and said evaporator is housed below the partition.

28. A merchandiser as set forth in claim 27 wherein said compressor and condenser are housed above said warm compartment.

29. A merchandiser as set forth in claim 27 wherein said evaporator is housed adjacent a top of said cold compartment.

30. A merchandiser as set forth in claim 27 wherein said evaporator is housed at a bottom of said cold compartment.

* * * * *